US006161515A

United States Patent [19]

Kopec

[11] Patent Number: 6,161,515

[45] Date of Patent: Dec. 19, 2000

[54] METHOD FOR CONTROLLING OUTPUT PRESSURE OF AN ENGINE OIL PUMP

[75] Inventor: Mark A. Kopec, Clarkston, Mich.

[73] Assignee: BorgWarner Inc., Troy, Mich.

[21] Appl. No.: 09/356,039

[22] Filed: Jul. 16, 1999

Related U.S. Application Data

[63] Continuation-in-part of application No. 09/124,612, Jul. 29, 1998.

[51] Int. Cl.[7] ..... F01M 1/02

[52] U.S. Cl. ..... 123/196 R; 123/196 CP

[58] Field of Search ..... 123/196 R, 196 CP; 417/307, 309; 184/6.5

[56] References Cited

U.S. PATENT DOCUMENTS

| | | | |
|---|---|---|---|
| 2,184,133 | 12/1939 | Wahlmark | 417/309 |
| 2,469,362 | 5/1949 | Bashark . | |
| 2,914,137 | 11/1959 | Sykes, Jr. | 123/192.2 |
| 3,618,708 | 11/1971 | Deines . | |
| 3,837,432 | 9/1974 | McKendrick . | |
| 4,157,132 | 6/1979 | Kramer . | |
| 4,222,712 | 9/1980 | Huber et al. | 417/309 |
| 4,512,298 | 4/1985 | Hayashi . | |
| 4,628,877 | 12/1986 | Sundles et al. . | |
| 4,648,363 | 3/1987 | Kronich | 123/196 R |
| 4,890,695 | 1/1990 | Morris et al. . | |
| 5,017,099 | 5/1991 | Tan | 417/307 |
| 5,038,893 | 8/1991 | Willner et al. . | |
| 5,211,544 | 5/1993 | Klumpp et al. | 417/286 |
| 5,285,871 | 2/1994 | Sievenpiper . | |
| 5,287,833 | 2/1994 | Yashiro . | |
| 5,339,776 | 8/1994 | Regueiro | 123/196 CP |
| 5,355,851 | 10/1994 | Kamiya | 123/196 R |
| 5,471,958 | 12/1995 | Niemchick et al. | 123/196 CP |
| 5,497,852 | 3/1996 | Little et al. . | |
| 5,511,524 | 4/1996 | Kidera et al. . | |
| 5,769,182 | 7/1998 | Parenteau . | |
| 6,082,321 | 7/2000 | Kopec | 123/196 R |

*Primary Examiner*—Tony M. Argenbright
*Assistant Examiner*—Jason Benton
*Attorney, Agent, or Firm*—Philip R. Warn; Greg Dziegielewski

[57] ABSTRACT

A lubrication system is provided, including a pressure control valve for regulating oil pressure in an internal combustion engine of a motor vehicle. An oil pump for circulating oil through the lubrication system is connected in flow communication with an engine lubrication circuit and a sump. A control valve in the oil pump is slidably movable in response to a control oil pressure. As oil pressure increases, the control valve functions to recirculate some of the oil back into the oil pump. By recirculating the oil, the control valve controls the flow of oil from the oil pump, and thereby regulating oil pressure in the lubrication system. During a cold engine start, the pressure control valve is actuated using a combined oil pressure, where a check valve is used to blend a first pressure prevailing at the outlet of said oil pump and a second pressure prevailing at or near the end of the lubrication circuit and. During warm engine operation, the check valve closes and prevents the blending of the oil pressure prevailing at the outlet of the oil pump. Thus, the pressure control valve is only actuated by oil pressure prevailing at or near the end of the lubrication circuit.

16 Claims, 9 Drawing Sheets

METHOD FOR CONTROLLING OUTPUT PRESSURE OF AN ENGINE OIL PUMP

CROSS-REFERENCE TO RELATED APPLICATION

This is a continuation-in-part of U.S. patent application Ser. No. 09/124,612, filed Jul. 29, 1998.

BACKGROUND OF THE INVENTION

1. Field of the Invention

The present invention relates generally to a pressure control valve and, more particularly, to a method for controlling the pilot pressure delivered to a pressure control valve of an engine oil pump.

2. Discussion

Engine lubrication is necessary to reduce friction and thus prevent excessive engine wear. To reduce friction, an oil pump circulates oil or other lubricants (under pressure) through the engine block, cylinder heads, etc. of a motor vehicle to lubricate its various moving parts, such as the camshaft, crankshaft, pistons and other various bearings.

Various ways have been proposed for controlling the amount of oil supplied to the engine. One way in which the amount of oil can be controlled is through a pressure control valve which selectively supplies oil from the pump to the engine. Typically, the oil pressure prevailing at the outlet of the oil pump is used to actuate the pressure control valve. Actuation of this control valve causes oil to be re-circulated back to an internal chamber of the oil pump or the oil sump. In this way, the pressure control valve not only controls the flow of oil into the lubrication circuit, but also regulates the output oil pressure from the pump.

It is an object of the present invention to control the flow of lubrication from the oil pump by using a pressure control valve, and thereby regulate pressure in the lubrication system.

It is another object of the present invention to blend or combine the oil pressure prevailing at the outlet of the oil pump with the oil pressure prevailing at or near the end of the remaining lubrication circuit for providing a more stable means of controlling the pressure control valve.

It is yet another object of the present invention to prevent excessive pump pressure during a cold start by blending or combining the oil pressure prevailing at the outlet of the oil pump with the oil pressure prevailing at or near the end of the remaining lubrication circuit, thereby providing a more stable means of controlling the pressure control valve, and during warm operation, the pressure control valve is actuated using the oil pressure prevailing at or near the end of the lubrication circuit, thereby better regulating oil pressure for all bearings regardless of the bearing clearance condition.

SUMMARY OF THE INVENTION

In accordance with the teachings of the present invention, a lubrication system is provided, including a pressure control valve for regulating oil pressure in an internal combustion engine of a motor vehicle. An oil pump for circulating oil through the lubrication system is connected in flow communication with an engine lubrication circuit and a sump. The pressure control valve in the oil pump is slideably movable in response to a control oil pressure. As oil pressure increases, the pressure control valve functions to re-circulate some of the oil back into the oil pump. By re-circulating the oil, the pressure control valve controls the flow of oil from the oil pump thereby regulating oil pressure in the lubrication system. To provide a more stable response by the pressure control valve, the control pressure used to actuate the valve is blended from a pressure prevailing at the outlet of said oil pump and a pressure prevailing at or near the end of the lubrication circuit.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENTS

The following discussion of the preferred embodiments directed to a lubrication system for an internal combustion engine of a motor vehicle is merely exemplary in nature and is in no way intended to limit the invention or its applications or uses.

Figure 1:
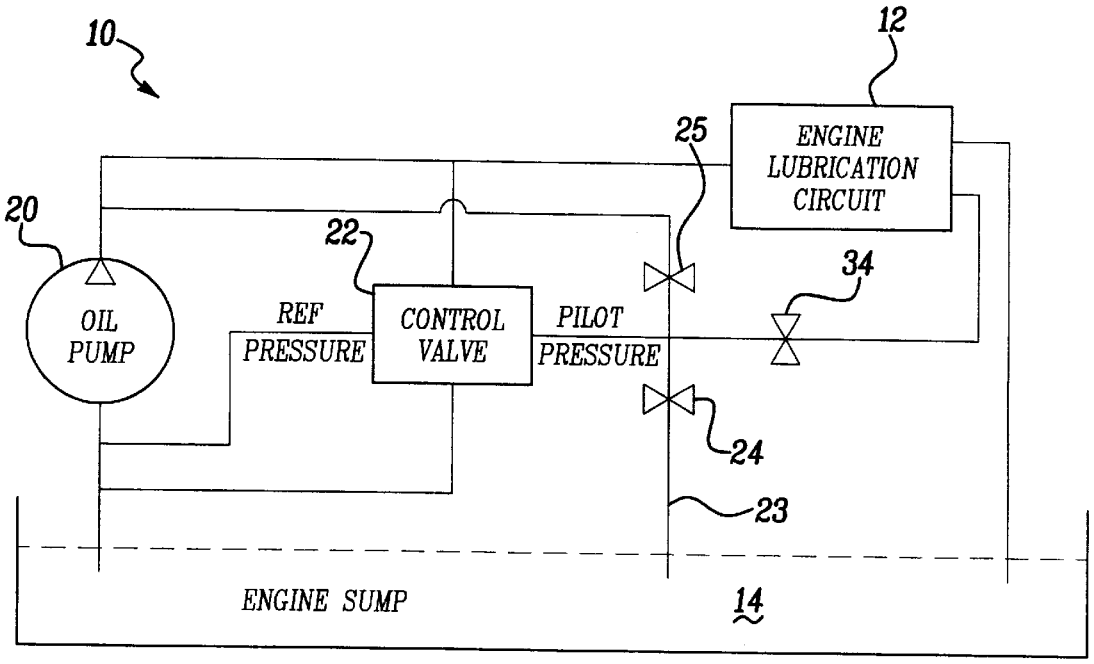
FIG. 1 is a block diagram showing the components of a lubrication system in accordance with the present invention.

A lubrication system 10 for use in an internal combustion engine of a motor vehicle is illustrated in FIG. 1. An oil pump 20 or other lubrication drive means is connected in fluid communication to an engine lubrication circuit 12 for circulating oil or other lubricants through the engine. Within engine lubrication circuit 12, oil is being supplied to a majority of the moving parts of the engine, including but not limited to the main bearings and the connecting rod bearings. A sump 14 is connected in fluid communication between oil pump 20 and lubrication circuit 12, such that it serves as a reservoir that is drawn upon by oil pump 20 and an outlet that is drained into by lubricant circuit 12. As will be apparent to one skilled in the art, there are many drip returns from lubrication circuit 12 back to sump 14.

A pressure control valve 22 is incorporated into oil pump 20 for regulating oil pressure throughout lubrication system 10. Pressure control valve 22 is typically acted upon and thus slideably movable in response to the oil from the outlet of oil pump 20. Initially, pressure control valve 22 allows complete throughput of oil to pass from the outlet of oil pump 20 into the lubrication circuit 12. As oil pressure increases, pressure control valve 22 functions to re-circulate some of the oil back into the oil pump 20 or the sump 14, and thus regulates the flow of oil into lubrication circuit 12.

As seen in FIG. 1, the oil pressure from the outlet of oil pump 20 is blended or averaged with the oil pressure at or near the end of lubrication circuit 12 to improve control over the output oil pressure from oil pump 20. At least one benefit of combining these two oil pressures is that it provides a more stable means of regulating pressure control valve 22. For instance, during a cold start of the engine, oil pressure at the outlet of oil pump 20 is relatively high in comparison to the low oil pressure at the end of lubrication circuit 12. The higher pressure at the outlet of oil pump 20 is not indicative of the pressure throughout lubrication circuit 12. A combined oil pressure more accurately represents oil pressure throughout the lubrication system and thus is used as the feedback control variable. As a result, the present invention ensures that there is adequate oil pressure at the end of lubrication circuit 12 during a cold start condition, thereby reducing wear and extending the life of moving parts throughout the engine.

A bleed 23 is provided from pressure control valve 22 to the sump 14 for relieving oil pressure in the lubrication system 10. In this way, the bleed 23 ensures an adequate oil flow rate throughout the lubrication system 10. It may also include a bleed restriction 24 which facilitates the bleeding of the oil pressure within the lubrication system 10. To prevent unfiltered dirty oil from flowing back into lubrication system 10, a pump feed restriction 25 and a lube circuit feed restriction 34 are also incorporated into the present invention.

Figure 2:
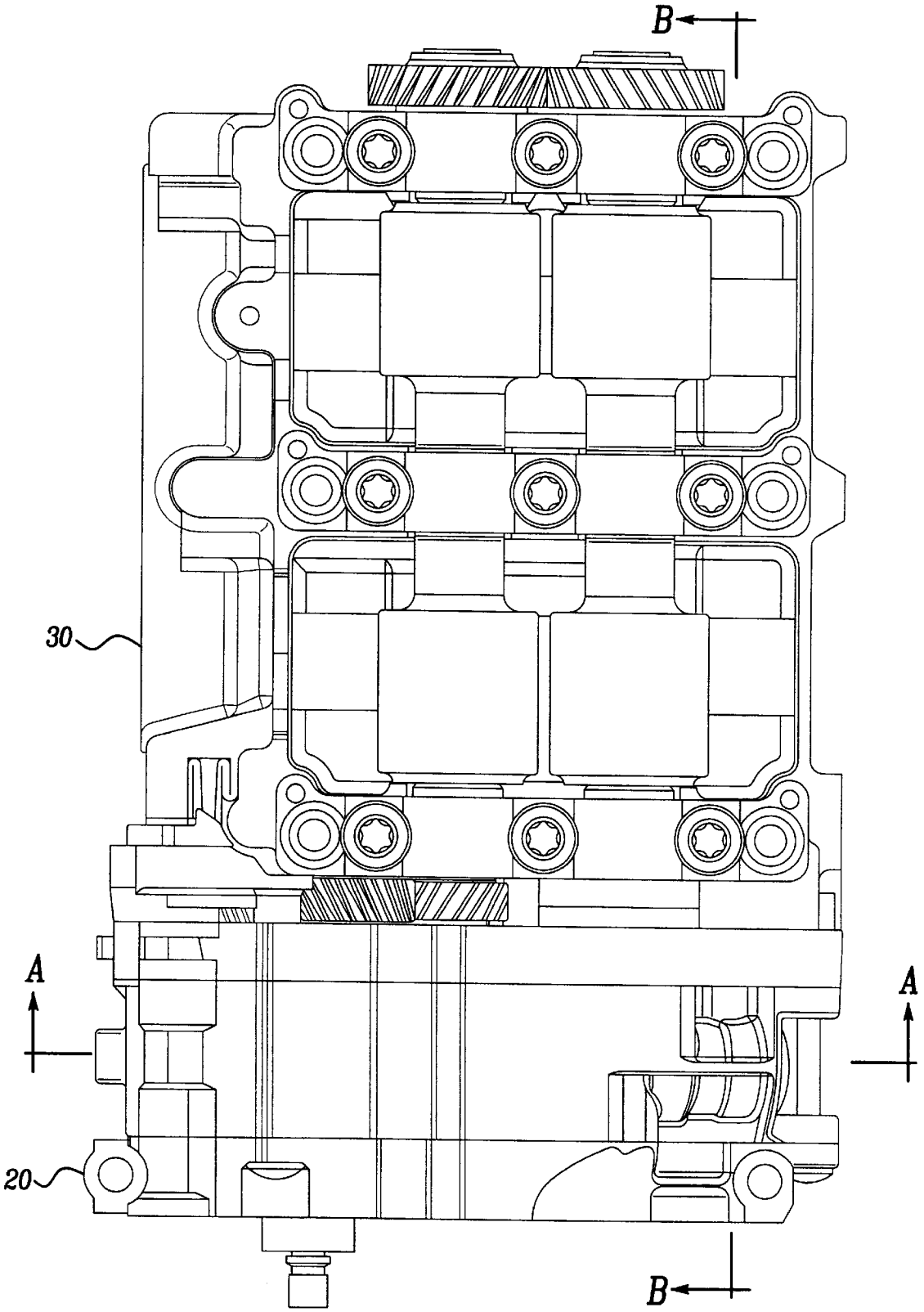
FIG. 2 is a top view of a preferred embodiment of an oil pump assembly coupled to a balance shaft assembly in the lubrication system of the present invention.
Figure 3:
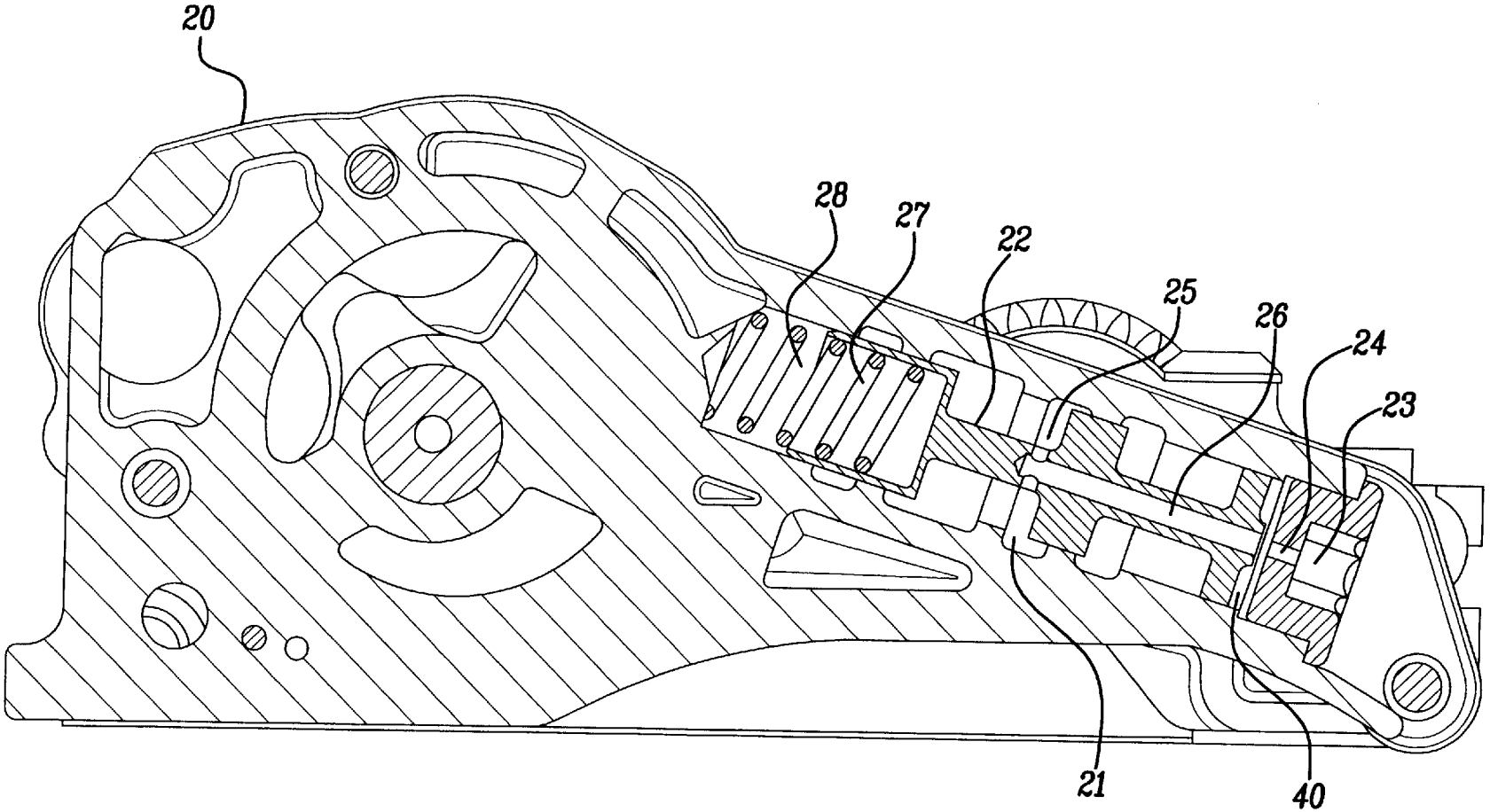
FIG. 3 is a cross-sectional view, taken along A—A of FIG. 2, of the oil pump assembly of the present invention.
Figure 4:
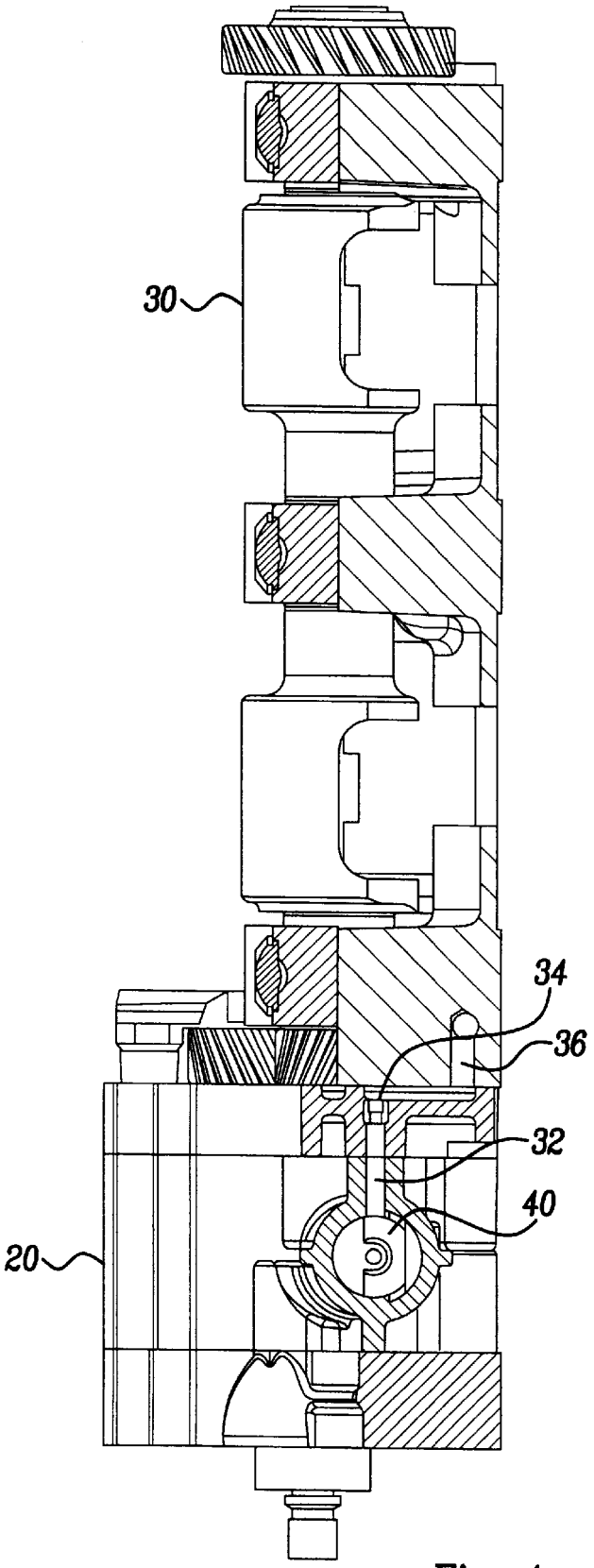
FIG. 4 is a cross-sectional view, taken along B—B of FIG. 2, of the oil pump assembly and balance shaft assembly of the present invention.

A first preferred embodiment of the present invention is shown in FIGS. 2–4. Referring to FIG. 2, a two-stage oil pump 20 is coupled to balance shaft assembly 30 to comprise a portion of the lubrication system 10. As will be apparent to one skilled in the art, oil pump 20 and balance shaft assembly 30 can be integrated with the remainder of an engine's lubrication circuit and sump. Although an exemplary use for the invention is in conjunction with a two-stage oil pump, this is not intended as a limitation on the broader aspects of the invention.

Referring to FIG. 3, oil prevailing at the outlet of oil pump 20 is fed back through an inlet 21 into pressure control valve 22 where a pump feed restriction 25 allows passage of the oil into an inner channel 26 of pressure control valve 22. As a result, oil from the outlet of oil pump 20 is blended with oil from the end of the lubrication circuit (as described below) to form a combined pressure 40. Pressure control valve 22 is being constantly acted on by combined pressure 40 and therefore is slideably movable in response to an increase in combined pressure 40. A spring or other elastic member 27 plus a reference pressure 28 counteracts the movement of pressure control valve 22 in relation to combined pressure 40. Movement of pressure control valve 22 causes oil to be re-circulated into one or more internal chambers of oil pump 20, thereby controlling the flow of oil from oil pump 20. One skilled in the art will recognize that the load and rate of the spring is determined based on the desired output pressure of oil pump 20.

FIG. 4 illustrates how a second oil pressure from counterbalance assembly 30 is blended with oil from the outlet of oil pump 20. A communication channel 32 allows oil to flow from a lubrication circuit 36 of balance shaft assembly 30 through lube feed restriction 34 and into the channel of pressure control valve 22. As previously described, the second oil pressure contributes to combined pressure 40 that is acting on pressure control valve 22. Although tapping this second oil pressure from balance shaft assembly 30 is presently preferred, this is not intended as a limitation of the broader aspects of the present invention. On the contrary, other locations at or near the end of the lubrication circuit may be suitable for obtaining a second oil pressure.

Figure 5:
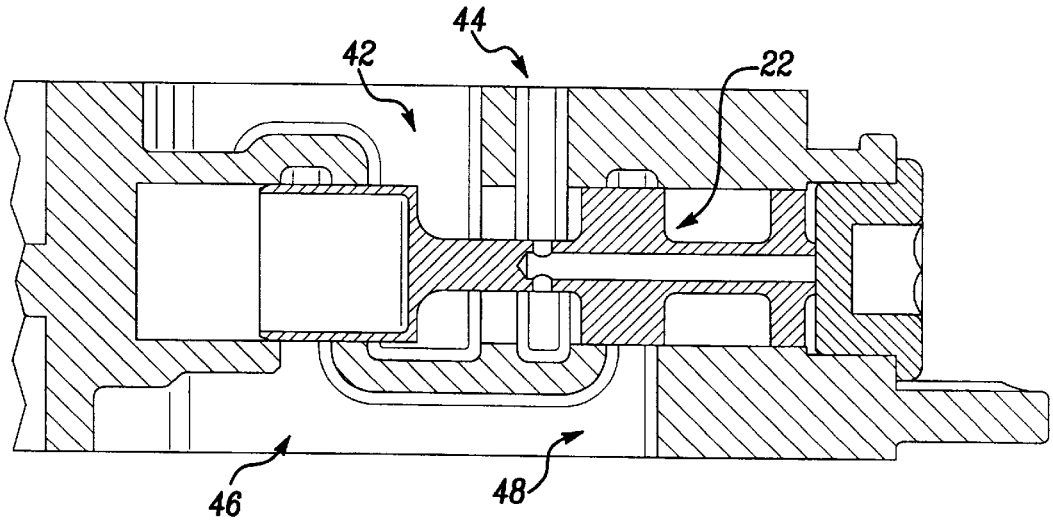
FIGS. 5–7 are fragmentary cross-sectional views, taken along A—A of FIG. 2, of the oil pump assembly illustrating the actuation of a pressure control valve in the present invention.
Figure 6:
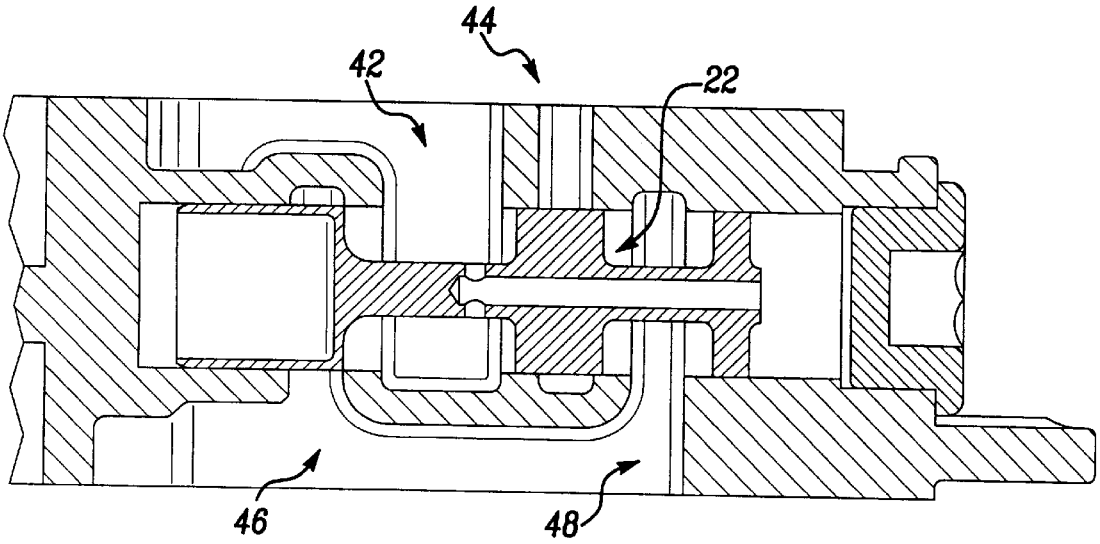
Figure 7:
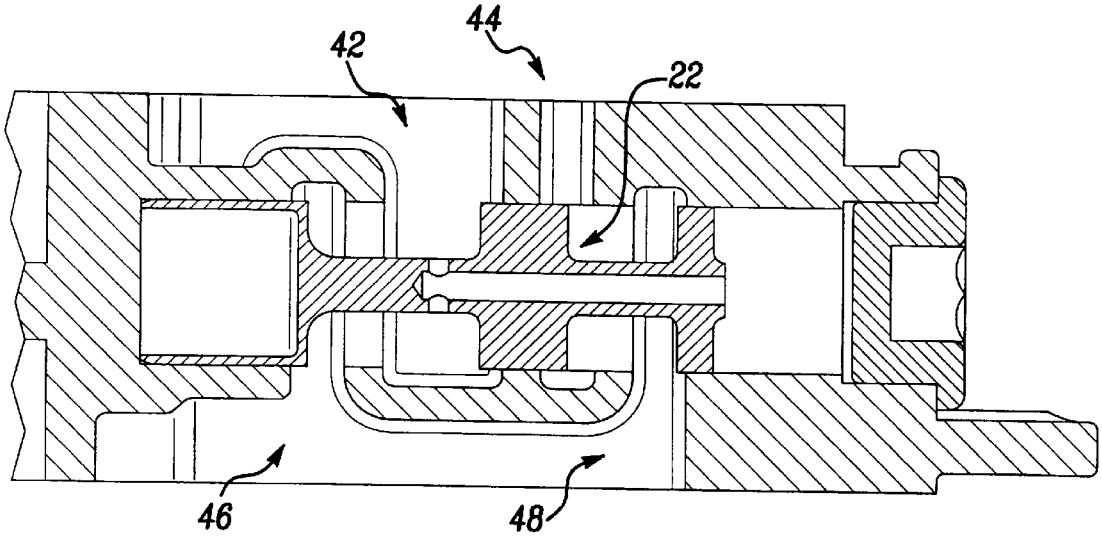

FIGS. 5–7 illustrate how the pressure control valve from the preferred embodiment might be actuated to re-circulate the oil in the pump. In FIG. 5, when the oil pressure is low, pressure control valve 22 is shown in an initial unactuated position. Oil pressure from the outlet of the pump prevails at pressure control valve 22 via a first discharge channel 42 and a second discharge channel 44. In this initial position, first discharge channel 42 is open to second discharge channel 44, but first discharge channel 42 is closed to a first exhaust channel 46 and second discharge channel 44 is closed to a second exhaust channel 48. As a result, no oil is being re-circulated back into the pump and thus all of the oil flow is forced through the outlet of the pump and into the lubrication circuit.

As the oil pressure in the lubrication system builds (e.g., up to 375 kPa), pressure control valve 22 is slideably movable to different positions. In FIG. 6, pressure control valve 22 reaches an intermediate transition position (about 10 mm displacement) such that second discharge channel 44 is closed to first discharge channel 42. In addition, first discharge channel 42 remains closed to first exhaust channel 46 and second discharge channel 44 remains closed to second exhaust channel 48. During this momentary transition period, a one-way "pop-off" valve (not shown) opens to allow the oil in the second discharge channel to flow through to the outlet of the pump. Immediately following this transition period, the second discharge channel 46 opens to the second exhaust channel 48 while the first discharge channel 42 remains closed to first exhaust channel 46. In this way, oil prevailing at the second discharge 44 begins re-circulating back into the pump through second exhaust channel 48.

In FIG. 7, an increasing oil pressure has actuated pressure control valve 22 to a fully open position (about 14 mm displacement). Second discharge channel 44 remains open to second exhaust channel 48 and closed to first discharge channel 42. However, first discharge channel 42 is at least partially open to first exhaust channel 46, thereby increasing the amount of oil being re-circulated back into the pump. As more oil is being re-circulated back into the pump, the output oil pressure from the pump decreases. At some second predefined oil pressure (e.g., 525 pa or higher), pressure control valve 22 actuates to a completely open position. As will be apparent to one skilled in the art, the above described embodiment of the pressure control valve is merely exemplary and other types of designs for how to re-circulate the oil in the pump fall within the scope of the present invention.

Figure 8:
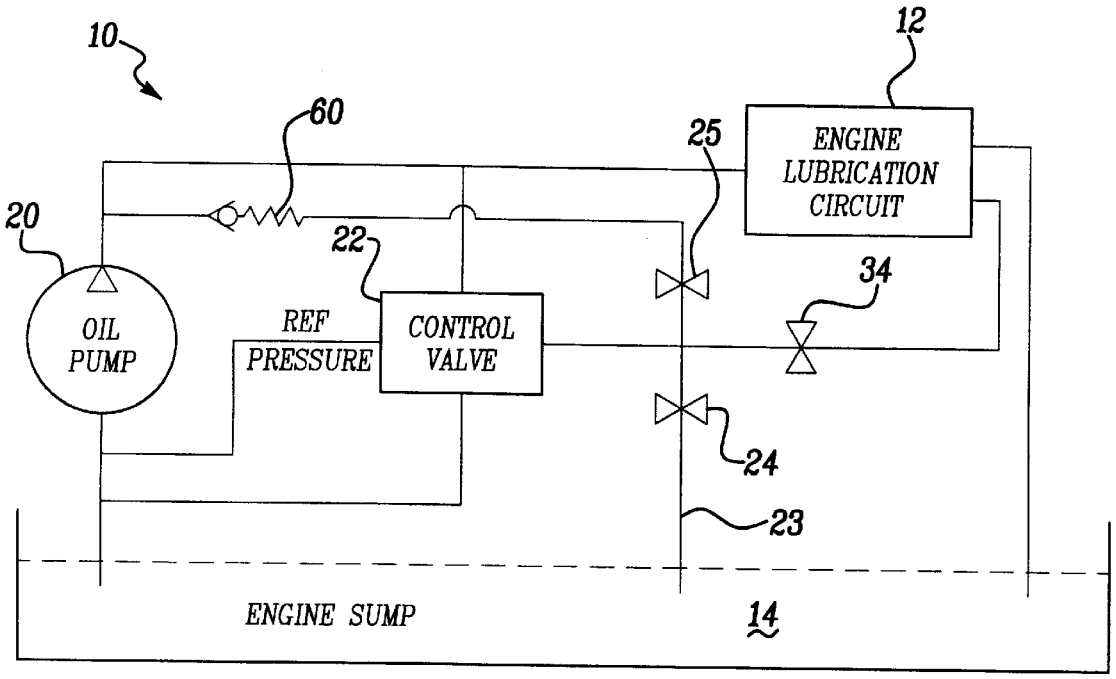
FIG. 8 is a block diagram showing a second preferred embodiment of the lubrication system of the present invention

A second embodiment of the present invention is shown in FIG. 8. In this case, a check valve 60 is positioned between the outlet of the oil pump 20 and the control valve 22. In the cold start case and until the control pressure causes the movement of the control valve 22, the long transfer time of the pressure rise through the lubrication circuit 12 allows for large pressure build up at the outlet of the oil pump 20. In order to limit the excessive pressure condition, the oil at the outlet of the oil pump 20 is directed through the check valve 60 to the control valve 22. The check valve 60 is open because the oil pressure at the outlet of the oil pump 20 is relatively high compared to the oil pressure at or near the end of the lubrication circuit. In this way, the oil pressure from the outlet of oil pump 20 is blended with the oil pressure at or near the end of lubrication circuit 12.

In contrast with the first embodiment, during warm engine operation, the control valve 22 will be responsive to pressure prevailing substantially at the end of the lubrication circuit 12. At this point, the oil pressure is relatively the same on either side of the check valve 60. As a result, the check valve 60 is closed and the pressure control valve is only actuated by oil pressure prevailing at or near the end of the lubrication circuit. By actuating the control valve 22 using the oil pressure prevailing at or near the end of the lubrication circuit 12, the present invention better regulates the oil pressure for all bearings during warm operation of the engine, regardless of the bearing clearance condition. One skilled in the art will readily determine a preferred hold-off pressure or a threshold pressure for the check valve 60, such that the oil pressure at the pump outlet facilitates oil flow during a cold start but remains within the mechanical limitations of the pump.

Figure 9:
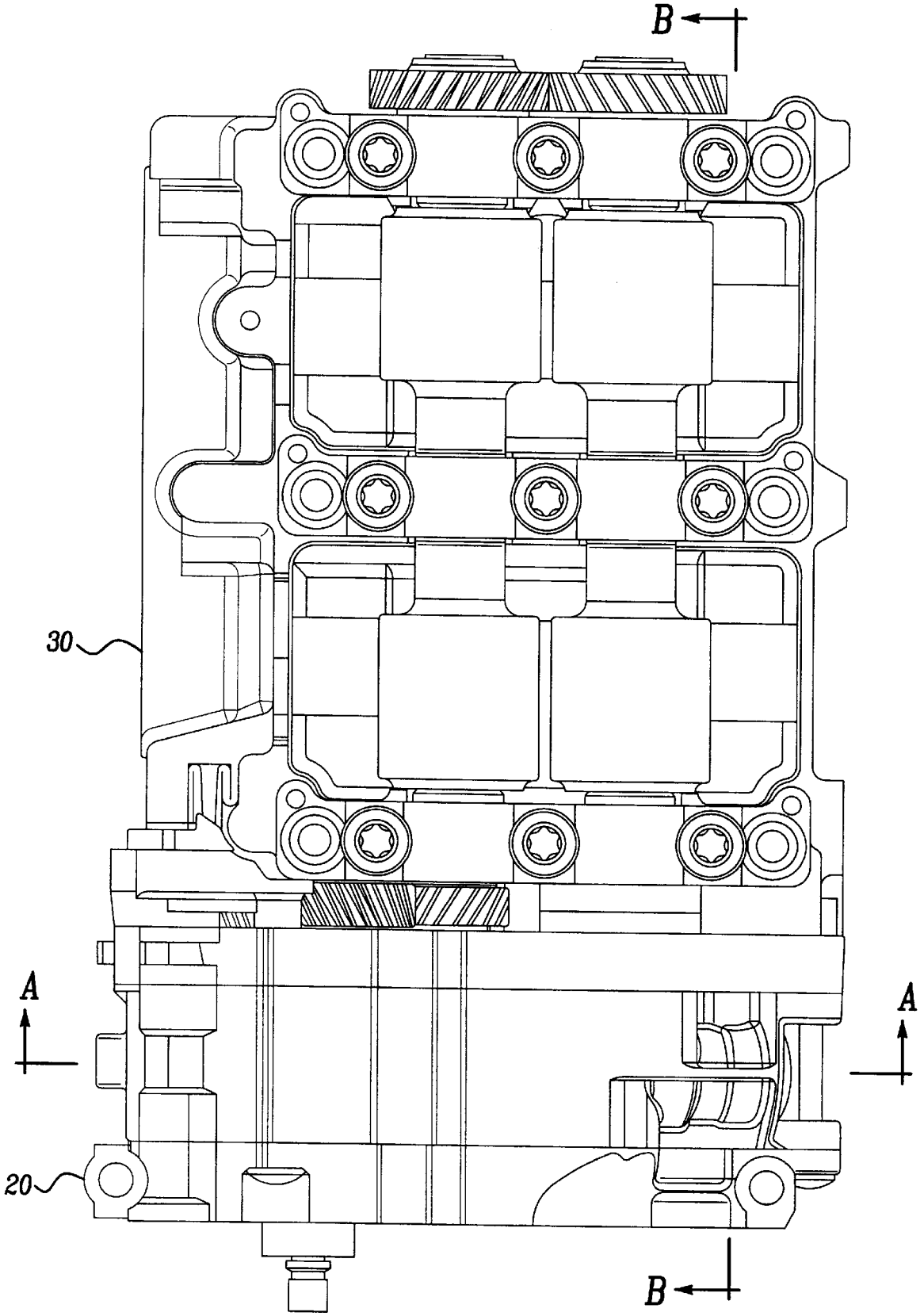
FIG. 9 is a top view of an oil pump assembly coupled to a balance shaft assembly in the second preferred embodiment of the lubrication system of the present invention.
Figure 10:
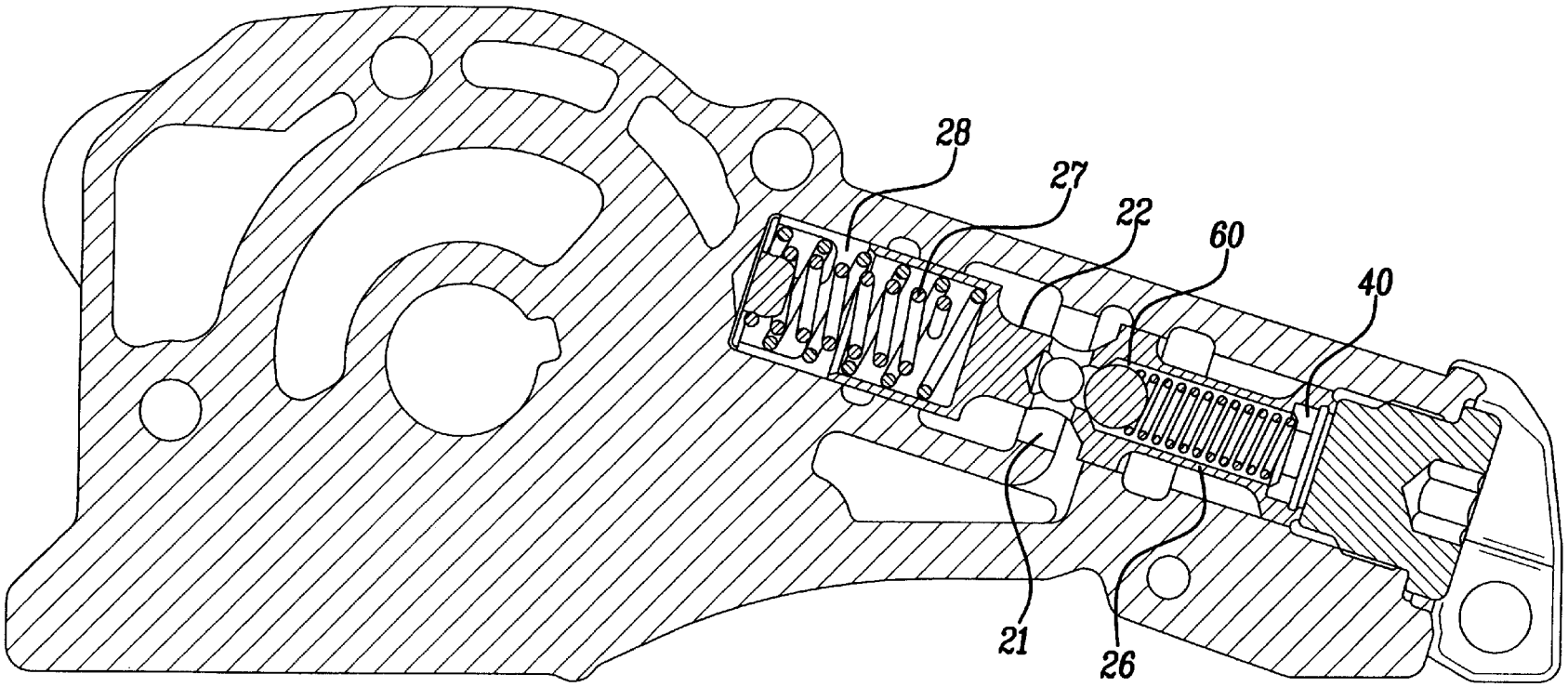
FIG. 10 is a cross-sectional view, taken along A—A of FIG. 9, of the oil pump assembly of the present invention.
Figure 11:
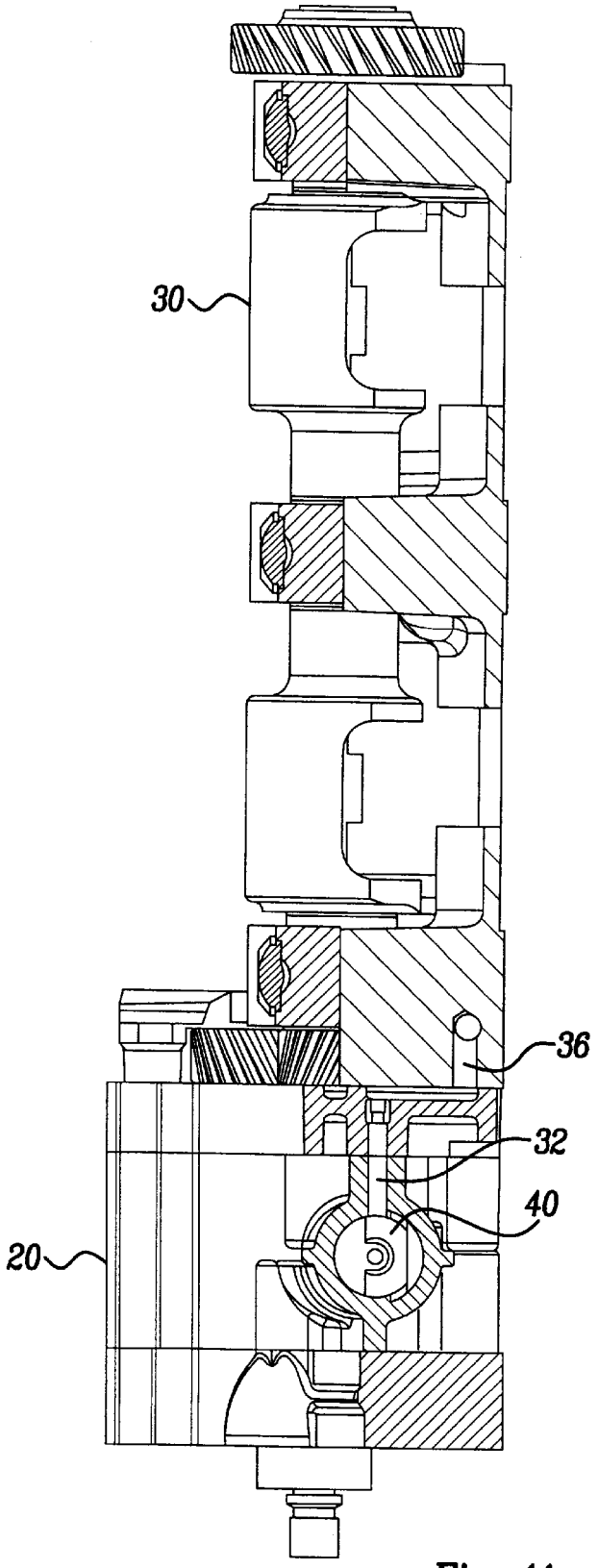
FIG. 11 is a cross-sectional view, taken along B—B of FIG. 9, of the oil pump assembly and balance shaft assembly of the present invention.

The second preferred embodiment of the present invention is also shown in FIGS. 9–11. Again, a two-stage oil pump 20 is coupled to balance shaft assembly 30 to comprise a portion of the lubrication system 10 as shown in FIG. 9.

Referring to FIG. 10, oil pressure prevailing at the outlet of oil pump 20 is fed back through an inlet 21 into pressure control valve 22. When the check valve 60 is open, oil passes through an inner channel 26 of pressure control valve 22. As a result, oil from the outlet of oil pump 20 is blended with oil from the end of the lubrication circuit (as described below) to form a combined pressure 40. Pressure control valve 22 is being constantly acted on by combined pressure 40 and therefore is slideably movable in response to an increase in combined pressure 40. A spring or other elastic member 27 plus a reference pressure 28 counteracts the movement of pressure control valve 22 in relation to combined pressure 40. Movement of pressure control valve 22 causes oil to be re-circulated into one or more internal chambers of oil pump 20, thereby controlling the flow of oil from oil pump 20.

FIG. 11 illustrates how a second oil pressure from counter-balance assembly 30 is blended with oil from the outlet of oil pump 20. A communication channel 32 allows oil to flow from a lubrication circuit 36 of balance shaft assembly 30 into the inner channel of pressure control valve (as shown at 40 on FIG. 4). As previously described, the second oil pressure contributes to the combined pressure 40 that is acting on pressure control valve 22. Although tapping this second oil pressure from balance shaft assembly 30 is presently preferred, this is not intended as a limitation of the broader aspects of the present invention. On the contrary, other locations at or near the end of the lubrication circuit may be suitable for obtaining a second oil pressure.

While the above description constitutes the preferred embodiment of the invention, it will be appreciated that the invention is susceptible to modification, variation, and change without departing from the proper scope or fair meaning of the accompanying claims.

What is claimed is:

1. A lubrication system for an internal combustion engine of a motor vehicle, comprising:

an engine lubrication circuit;

a sump connected with said lubrication circuit;

a lubrication pump connected with said sump and said lubrication circuit for circulating a lubricant through said lubrication circuit;

a control valve of said lubrication pump for controlling the flow of lubrication from said lubrication pump; and a check valve positioned between said lubricating pump and said control valve for controlling the flow of lubricant from said lubricating pump to said control valve, wherein said control valve is responsive to a first combined pressure of said lubricant when the pressure acting on said check valve exceeds a threshold pressure, said first combined pressure being defined as the pressure prevailing at an outlet of said lubricating pump and the pressure prevailing substantially at the end of said lubrication circuit, and responsive to the pressure prevailing substantially at the end of said lubrication circuit when the pressure acting on said check valve is below said threshold pressure, thereby regulating pressure in the lubrication system.

2. The lubrication system of claim 1 wherein said control valve is constantly acted on by and slidably movable in response to an increase of either said first combined pressure or said second pressure.

3. The lubrication system of claim 1 wherein said slidably movable control valve recirculates said lubricant into at least one internal chamber of said lubrication pump, thereby controlling the flow of lubrication from said lubrication pump.

4. The lubrication system of claim 1 wherein said lubrication pump is connected to a counter-balance assembly of said lubrication circuit, thereby providing the pressure prevailing substantially at the end of said lubrication circuit.

5. The lubrication system of claim 1 further comprising a release outlet for bleeding said lubricant from said lubrication pump into said sump, thereby improving the flow rate of said lubricant.

6. The lubrication system of claim 1 further comprising a pump feed restriction between said lubrication pump and said control valve and a lubrication circuit restriction between said control valve and said lubrication circuit.

7. A lubrication system for an internal combustion engine of a motor vehicle, comprising:

an engine lubrication circuit, having a counter-balance assembly;

a sump connected in flow communication with said lubrication circuit;

an oil pump connected in flow communication with said engine lubrication circuit and with said sump, having an outlet for pumping a lubricant from said sump through said lubrication circuit and back to said sump;

a pressure control valve of said lubrication pump for controlling the flow of lubrication from said lubrication pump; and a check valve positioned between said outlet of said lubricating pump and said control valve for controlling the flow of lubricant from the outlet of said oil pump to said control valve, wherein said control valve is slidably movable in response to a first combined pressure of said lubricant when the pressure acting on said check valve exceeds a threshold pressure, said first combined pressure being defined as the pressure prevailing at an outlet of said lubricating pump and the pressure prevailing substantially at the end of said lubrication circuit, and responsive to the pressure prevailing substantially at the end of said lubrication circuit when the pressure acting on said check valve is at or below said threshold pressure, thereby regulating pressure in the lubrication system.

8. The lubrication system of claim 7 wherein said control valve recirculates said lubricant into at least one internal chamber of oil pump, thereby controlling the flow of lubrication from said oil pump.

9. The lubrication system of claim 7 wherein said oil pump being in fluid communication through a communication channel with a counter-balance assembly of said lubrication circuit for providing said second pressure.

10. The lubrication system of claim 7 further comprising a release outlet for bleeding said lubricant from said oil pump into said sump, thereby improving the flow rate of said lubricant.

11. The lubrication system of claim 7 further comprising a pump feed restriction between the outlet of said oil pump and said control valve and a lubrication circuit restriction between said control valve and said lubrication circuit.

12. A method for regulating pressure in a lubrication system for an internal combustion engine of a motor vehicle, comprising the steps of:

providing an oil pump for circulating a lubricant through a lubrication circuit of the lubrication system;

controlling the flow of lubricant from said oil pump via a control valve of said oil pump;

positioning a check valve between said oil pump and said control valve, thereby restricting the flow of lubricant from said outlet to said control valve;

actuating the control valve in response to a first combined pressure of said lubricant when the pressure acting on said check valve exceeds a threshold pressure, said first combined pressure being defined as the pressure prevailing at the outlet of said oil pump and the pressure substantially at the end of the lubrication circuit; and actuating the control valve in response to the pressure prevailing substantially at the end of the lubrication circuit when the pressure acting on said check valve is below said threshold pressure, thereby regulating lubricant pressure in the lubrication system.

13. The method of claim 12 wherein said control valve being constantly acted on by said combined pressure and slidably movable in response to an increase in said first combined pressure and said second pressure.

14. The method of claim 12 wherein said slidably movable control valve recirculates said lubricant into at least one internal chamber of said lubrication pump, thereby controlling the flow of lubrication from said lubrication pump.

15. The method of claim 12 wherein said second pressure being provided from a counter-balance assembly in fluid communication through a tube with said oil pump.

16. The method of claim 12 further comprising the step of bleeding said lubricant from the oil pump to improve the flow rate of said lubricant.

* * * * *